United States Patent [19]

McGahan et al.

[11] 3,989,413

[45] Nov. 2, 1976

[54] GAS COMPRESSOR UNLOADING MEANS

[75] Inventors: Wallace A. McGahan, Lawrenceville, N.J.; Paul D. Webb, Tioga, Pa.; Henry W. Morse, Savona, N.Y.

[73] Assignee: Ingersoll-Rand Company, Woodcliff Lake, N.J.

[22] Filed: May 14, 1975

[21] Appl. No.: 577,347

[52] U.S. Cl. ..... 417/310; 418/206; 418/191

[51] Int. Cl.[2] ..... F04B 49/02; F01C 1/18; F01C 21/16; F04C 17/10

[58] Field of Search ..... 418/191, 205, 206; 417/310, 440

[56] References Cited

UNITED STATES PATENTS

| | | | |
|---|---|---|---|
| 2,097,037 | 10/1937 | Northey | 418/206 |
| 2,580,030 | 12/1951 | Lee | 417/310 |
| 3,472,445 | 10/1969 | Brown | 418/191 |
| 3,811,792 | 5/1974 | Kennedy | 417/310 |

FOREIGN PATENTS OR APPLICATIONS

| | | | |
|---|---|---|---|
| 1,303,685 | 8/1962 | France | 417/440 |
| 1,324,941 | 3/1963 | France | 418/191 |
| 420,501 | 12/1934 | United Kingdom | 417/440 |

*Primary Examiner*—John J. Vrablik
*Attorney, Agent, or Firm*—Bernard J. Murphy

[57] ABSTRACT

The unloading means comprise unloading ports, and valving therefor, for step-control unloading of a gas compressor. In a first embodiment, the unloading means are provided in side walls of a rotary, positive displacement, gas compressor, and in an alternate embodiment the unloading means are disposed within end walls (of a rotary, positive displacement, gas compressor), and comprehends means for step-control of a plural-stage machine.

12 Claims, 9 Drawing Figures

FIG. 4
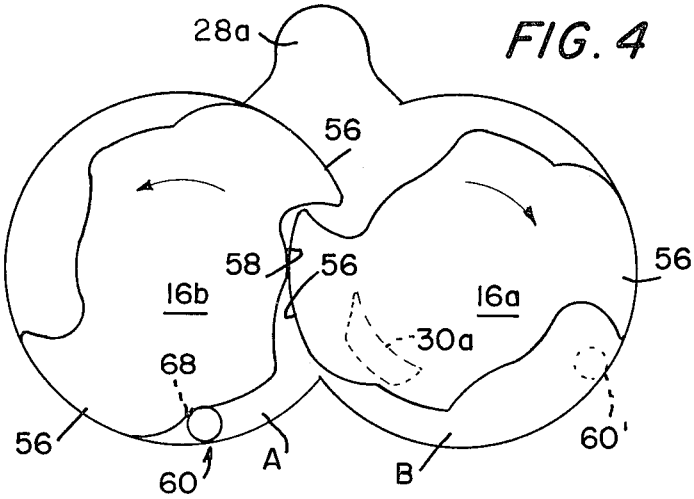
FIG. 8
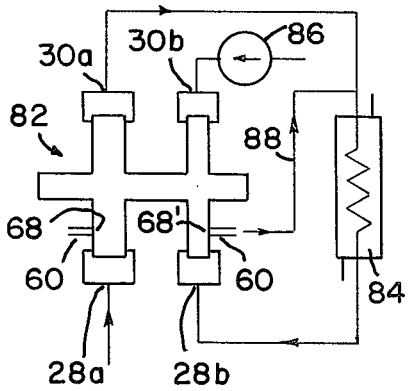
FIG. 5
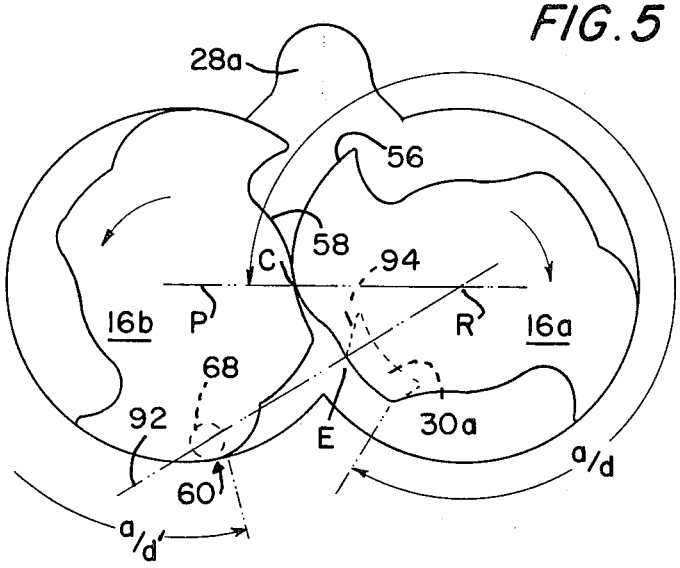
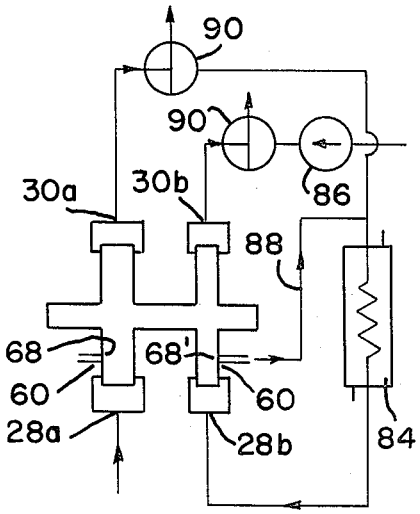
FIG. 9
FIG. 6
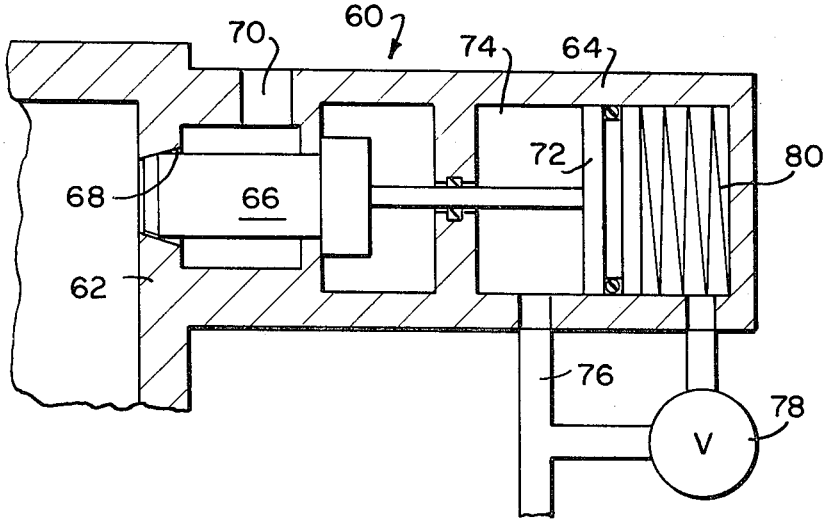

GAS COMPRESSOR UNLOADING MEANS

This invention pertains to unloading means for gas compressors, and in particular to such means for use in rotary-type, positive displacement machines which comprise a plurality of coacting, toothed-rotors which rotate in parallel bores in a housing.

In the prior art, unloading means for such gas compressors are known from U.S. Pat. No. 2,097,037 for a Rotary Compressor or Vacuum Pump, issued to A. J. Northey, on Oct. 26, 1937. However, in such prior art, of which the Northey apparatus is typical, the unloading means do not offer selective or "stepped" amounts of unloading; the same is operative only in response to a predetermined pressure in a receiver, and is inoperative at other times.

The present invention has as a feature, the provisioning of selective unloading of a rotary, positive displacement, gas compressor, by means of one or a plurality of valve-controlled unloading ports arranged in walls of the compressor housing.

Especially it is an object of this invention to set forth, in a rotary gas compressor having a compression chamber, chamber-confined rotary means for displacing and compressing gas in said chamber, and spaced apart gas inlet and outlet ports in communication with said chamber; unloading means for the compressor, comprising unloading port means, spaced apart from said inlet and outlet ports, opening both into said chamber and externally of said compressor, and valving means coupled to said unloading port means operative for opening and closing said unloading port means to a conduct of gas therethrough.

Further objects and features of this invention will become more apparent by reference to the following description taken in conjunction with the accompanying figures, in which:

FIGS. 2–5 are diagrammatic illustrations of an alternate embodiment of a dual-bore, rotary, positive, displacement, gas compressor, having an alternate embodiment of the novel unloading means incorporated therein;

FIG. 6 is a cross-sectional view of the unloading port and valving arrangement comprised by the unloading means of FIGS. 2–5; and FIGS. 7–9 are schematic diagrams of the unloading means of FIGS. 2–6 operatively employed in a two-stage gas compressor wherein each of the stages has coacting rotors of the type depicted in FIGS. 2–5.

Figure 1:
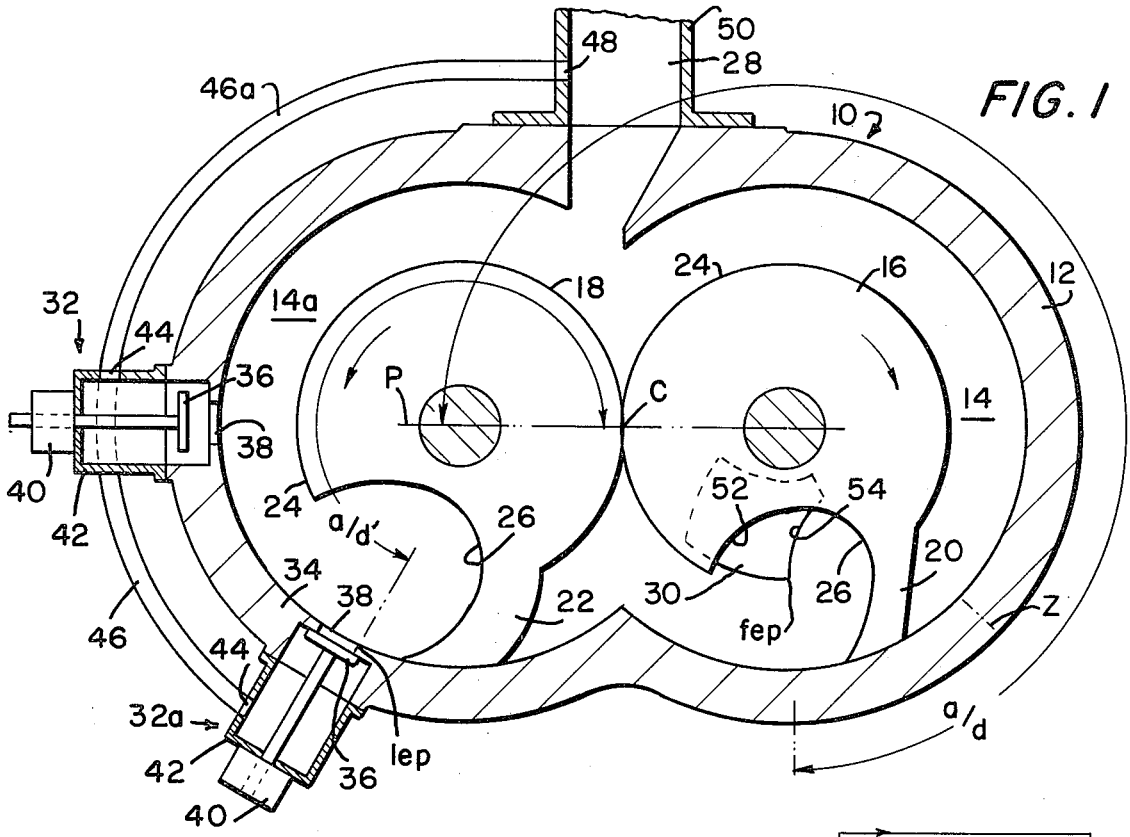
FIG. 1 is a vertical cross-sectional view of a dual-bore, rotary, positive displacement, gas compressor having an embodiment of the novel unloading means incorporated therein.

The rotary gas compressor 10 depicted in FIG. 1 is of the type described in U.S. Pat. No. 3,472,445 for "Rotary Positive Displacement Machines" issued to A. E. Brown on Oct. 14, 1969. The compressor 10 comprises a housing 12 which defines a pair of coaxial and intersecting bores 14 and 14*a* in which a gate rotor 16 and a main rotor 18 are rotatably supported, the same being driven by a motor or the like through timing gears. The rotors 16 and 18 each have a tooth 20 and 22, extending from a hub 24, and a groove 26 into which the respective teeth move as the rotors 16, 18 coact to move gas from an inlet port 28 to outlet ports 30 (only one being shown) formed in end walls of bore 14. The toothed rotors 16, 18 cooperate to define and reduce a volume of the compression chamber (formed of bores 14 and 14*a*) until the exhaust ports 30 are opened and the compressed gas product is discharged therethrough. Unloading means 32 and 32*a* according to an embodiment of the invention, are borne in a side wall 34 of the compressor 10 and, as shown in FIG. 1, two of such unloading means are provided. The first of the unloading means 32, which is arranged "up-stream", provides for approximately 50 per cent unloading of the gas compressor 10, whereas the second thereof, 32*a*, which is arranged "down-stream" provides for more than 50 per cent but less than 100 per cent unloading of the gas compressor.

Each of the means 32 and 32*a* comprises valving elements 36 movable for both closure and exposure of unloading ports 38 formed in the wall 34. The valving elements 36, according to this arrangement or embodiment, are operated by solenoids 40 which, in turn, are responsive to either manual control, or automatically respond to predetermined gas pressures either in point-of-use lines or in a receiver.

Each of the unloading means 32 and 32*a* comprises a housing 42 which has a vent port 44 formed therein and, as shown in FIG. 1, only diagrammatically, the vent ports 44 are coupled by conduits 46 and 46*a* to a side re-entry port 48 formed in the inlet pipe 50 of the compressor 10.

As noted, unloading means 32 can be opened to achieve approximately 50 per cent reduction of delivered capacity, and when both unloading means 32 and 32*a* are opened the compressor delivery falls to nearly zero. Unloading means 32*a* is so located such that it is covered by the tooth 22 of rotor 18 just at the same time in the compression cycle where the leading edge 52 of rotor 16 passes over the opening edge 54 of the discharging port 30. It is to be noted that the wide-angle tooth 22 completely covers ports 38 of unloading means 32 and 32*a* and thus prevents blow-back of pressurized gas.

In the FIG. 1 embodiment, the unloading means 32 and 32*a* are operative to dump back to the inlet quantities of gas which have been ingested, via port 28, without any appreciable energy or work having been expended on these dumped quantities. In effect, then, the unloading means 32 and 32*a* effectively reduce the working volume of the compression chamber of compressor 10. In contradistinction, the aforenoted U.S. Pat. No. 3,472,445 defines an arrangement wherein the compression chamber has no such dump facility. Rather, the whole ingested volume of gas is fully compressed, but some or all of the fully-worked product is returned to the inlet by a by-pass valving which communicates with the outlet port. The instant invention, then, offers a savings in energy or horsepower requirements over such prior art arrangements.

As noted, means 32 alone can be opened, to reduce the "workable" compression chamber volume perhaps 50 per cent. Too, both of the means 32 and 32*a* can be opened to reduce the "workable" volume perhaps to only zero or five per cent.

To avoid an inefficient dumping back of pressurized gas, i.e. gas that has been worked, there is a limitation on how far "down-stream" such unloading means, such as means 32*a*, may be located. Simply, such means may be that distance down-stream whereat it will be closed to communication with the outlet port 30 just immediately prior to the exposure of the outlet port to the compression chamber volume defined by bore 14. Such a distance, or the limitation of such a distance, can be substantially, angularly located. Rotors 16 and 18 rotate on parallel axes which are bisected by a plane "P", and they effect a contacting engagement with each other at a point "C" along that plane. Now then, if the first-exposed portion "fep" of the outlet port is located an angular distance "*a/d*" (in the direction of rotation of rotor 16) from point "C", then the last-exposed portion "lep" of the unloading means 32*a* must be located at a lesser, corresponding-angular distance. That is, the last-exposed portion "lep" of the unloading means 32*a* (relative to the direction of rotation of rotor 18) must be located at an angular distance "*a/d*'" from point "C"—"*a/d*'" being less than "*a/d*".

Patently, taking teaching from our disclosure, it may be found expedient to locate the unloading means in the peripheral wall of bore 14. Here too, then, the same limitation would obtain. The last-exposed portion of such unloading means would have to be located—now, relative to the direction of rotor 16—an angular distance from point "C" which is also less than distance "*a/d*". For the embodiment depicted in FIG. 1, this location would be as indicated by the index "Z".

The foregoing limitations, if efficient unloading means are to be employed, holds true whether the means are arranged in the circumferential or peripheral walls of the compressor 10, as shown in FIG. 1, or in end walls of the machine. In this connection, it is well to note that either peripherally-opening or axially-opening (end wall) unloading means can be employed, with equal facility, in a compressor 10 of the type depicted in FIG. 1.

In FIGS. 2 through 5 the gas compressor 10*a* is similar to that of compressor 10 of FIG. 1, except that, in this embodiment, the gas compressor 10*a* comprises a pair of coacting rotors 16*a* and 16*b* in which each rotor has a pair of teeth 56 and a pair of grooves 58 (to receive the teeth of the companion rotor), and the hub portions 24*a* are of limited angular width. Here too, the compressor 10*a* has an inlet port 28*a* and end-wall discharge ports 30*a*, but the unloading means 60 is carried in an end wall 62 of the compressor.

The unloading means 60 is shown in FIG. 6 in structural detail. The same comprises a valve housing 64, carried by the end wall 62 of the compressor 10*a*, in which a piston-type plunger 66 is slidably supported for opening and closing an unloading port 68 formed thereat. When the plunger 66 is fully displaced (to the right, in FIG. 6) it provides complete communication of the unloading port 68 with a vent port 70 formed in the valve housing 64. However, plunger 66, on its working end, is tapered, and so too is the unloading port 68 so that, in operation, unloading means 60 has a metering capacity responsive to disparities in gas pressure applied to opposite sides of the plunger piston 72, shown within a piston chamber 74 of the housing 64. Line pressure is addressed to one side of the piston via conduit 76, and a pressure derived from a reducing valve 78 is impressed on the other side of the piston whereat a compression spring 80 is also employed to urge the plunger 66 to a normally-closed position. Unlike the unloading means 32 and 32*a* shown in FIG. 1, which provide for either full unloading, or a fixed degree of partial unloading, as determined by the angular location of means 32 (or 32*a*), the unloading means 60 of FIG. 6 provide for an infinitely variable degree of unloading from zero to full unloading, depending upon the degree of opening of plunger 66.

Figure 7:
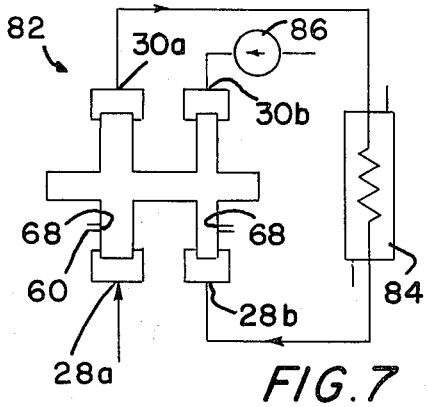

FIGS. 7 through 9 disclose how the unloading valve arrangement of FIGS. 2 through 6 is operative in a two-stage machine 82 where, in FIG. 7, the unloading port 68 for the first stage is closed. The compressed gas product of the first stage is conducted from the discharge port 30*a* through an intercooler 84 and to the second stage inlet 28*b* for further compression, unloading port 68' of the second stage also being closed, and the final compressed gas product is passed through a check valve 86 to line use or a receiver (not shown). Under this circumstance, as shown in FIG. 7, the two-stage compressor 82 is operating under full load.

In FIG. 8 the same two-stage compressor 82 is shown, but here the unloading ports 68 and 68' of the first and second stages are both open, and the unloading port 68' for the second stage is connected through a conduit 88 to the inlet side of the intercooler 84. By this arrangement, up to approximately 50 per cent unloading can be effected. As noted in the foregoing text, unloading means 60 is configured to provide metering. Thus, the degree of displacement of plunger 66, relative to port 68', will determine the degree of unloading: from zero to the approximately 50 per cent.

In the arrangement shown in FIG. 9, the same two-stage compressor 82 is schematically depicted with both unloading ports 68 and 68' open and both discharge ports 30*a* and 30*b* open, through vent valves 90, to the atmosphere. With this arrangement, a full one hundred per cent unloading of the machine is effected. Valves 90 are depicted as three-way types; such are not necessary, however. Simple blow-off valves, like those comprised by unloading means 60 should be adequate, as the check valve 86 (FIGS. 7–9) can prevent reverse flow.

Figure 2:
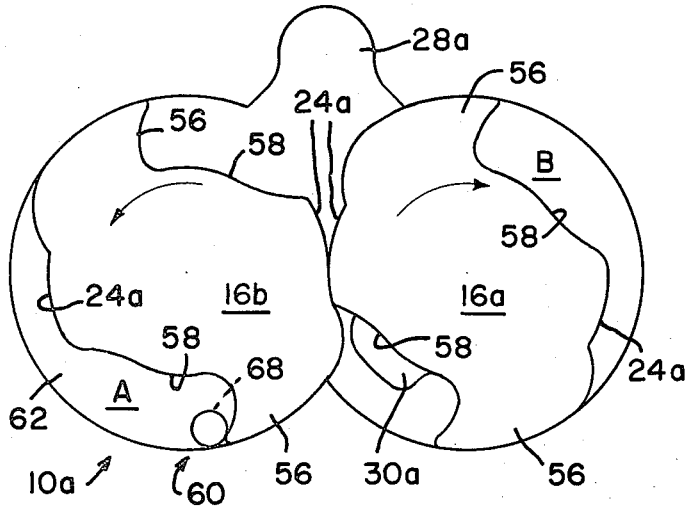
Figure 3:
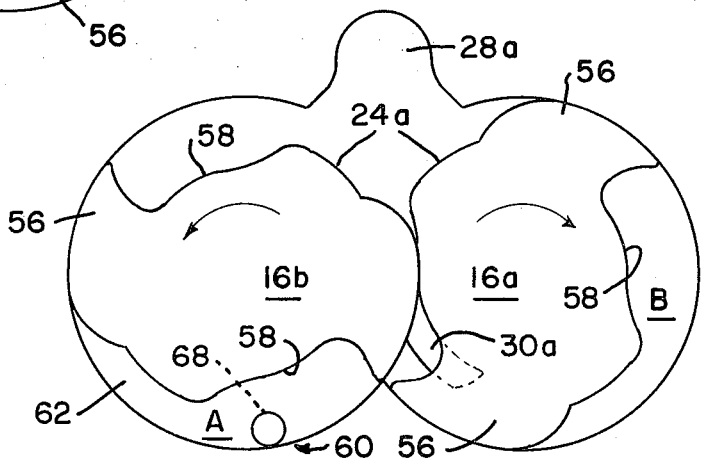

In FIG. 2, compartments A and B at full pocket volume and inlet pressure are being swept toward the discharge port 30*a*. With the port 68 open, compartment A remains open to atmosphere. FIG. 3 shows further rotation. In FIG. 4, compartment A has decreased in volume as a tooth 56, of rotor 16*a* passes into a groove 58 of rotor 16*b*. This would normally provide the built-in compression for the compressor. With the port 68 open, however, the gas in pocket A flows out to atmosphere rather than to be compressed as the volume decreases. Gas continues to flow out of the port 68 until the port is occluded by rotor 16*b* just prior to the opening of the discharge port 30*a*. This is shown in FIG. 5.

With complete unloading of the compressor, that is, with the discharge ports 30*a* and 30*b* open to atmosphere (per FIG. 9) and the ports 68 and 68' fully open, the unloading horsepower would only consist of friction losses since all of the built-in compression and discharge pressure has been removed.

As taught in the compressor-unloading prior art, liquid-injected, rotary, positive displacement compressors can be unloaded, with some horsepower reduction, by throttling the inlet while the discharge remains at full pressure. A further reduction can be obtained by blowing down the discharge with the inlet nearly closed off. Complete unloading, however, is not possible because of built-in compression. Such type of unloading is not possible on dry (i.e. non-liquid-injected), rotary compressors; injected liquid would be required to remove the heat generated. Our invention, however, sets forth unloading means which is capable of use in dry compressors.

Respecting the embodiments comprised by FIGS. 2–9, the same limitation, concerning the location of the furthermost "downstream" unloading means 60, applies. Simply, the last exposed portion of port 68 must finally be closed off from communication with the discharge port 30*a* just prior to the exposure of the first "cracking" portion of port 30*a* to the compression chamber. As FIG. 5 makes evident, the same aforenoted disparity of angular location needs to be observed. Again, alternatively, in lieu of unloading means 60 in an axial wall of the bore wherein rotor 16*b* operates, unloading means 60′—as shown in phantom in FIG. 4—could be arranged in an axial wall of the companion bore. Here too, then, its angular disposition must insure its being occluded, finally, prior to the "cracking" of port 30*a*.

Additionally, as a matter of interest it has been determined that, for maximum efficiency of the FIGS. 2–5 embodiments, the location of the unloading means 60 vis-a-vis the so-configured discharge port 30*a* is significant, given rotors 16*a* and 16*b*, or rotors of like configuration. Accordingly, it has been found that an imaginary radial line 92 (FIG. 5) drawn from the radial center "R" of gate rotor 16*a* and through the radially outermost portion of the trailing edge 94 of port 30*a* (or 30*b*) should substantially bisect the unloading means 60. This preferred structure is embodied in the machine depicted in FIGS. 2–9, where line 92, (as shown in FIG. 5) passes through such radially outermost edge portion "E" of port 30*a*, and exactly bisects unloading means 60.

While we have described our invention in connection with specific embodiments thereof it is to be clearly understood that this is done only by way of example and not as a limitation to the scope of our invention as set forth in the objects thereof and in the appended claims. For instance, in connection with the discussion of the FIG. 1 embodiment it was noted that, in lieu of the peripheral-wall unloading means 32 and 32*a*, axial-wall unloading means (like means 60, FIGS. 2–9) could be employed with equal benefit. So also, while axial-wall unloading means 60 are depicted in the embodiments of FIGS. 2–9, peripheral-wall unloading means could be used in lieu thereof.

Respecting the FIG. 1 embodiment, a further unloading means could be located intermediate means 32 and 32*a*, and still other unloading means could be emplaced further "upstream" of means 32 —if it should be desirable to further "step" sub-divide the unloading capability, or to enable only a very limited unloading, etc. As noted, too, one or a plurality of unloading means could be used to vent or dump the bore 14— to supplant or to supplement the means operative on bore 14*a*.

With reference to FIG. 7, it is the preferred and more simple teaching to dump the gas from the unloading means to atmosphere. Alternatively, if the gas ought not to be discharged to atmosphere, it can be returned to its respective inlet port (28*a* or 28*b*) from its respective unloading port (68 or 68*b*). Similarly, with reference to FIG. 9, gas vented from the discharge ports 30*a* and 30*b* could be returned to the inlets 28*a* and 28*b*, after passing through coolers, if the gas is one not to be discharged into atmosphere.

These and further alternative arrangements will likely suggest themselves to those unskilled in this art, by taking teaching from our disclosure. For this reason, we would point out that all such arrangements are believed to be within the ambit of our claims.

We claim:

1. In a rotary gas compressor having a compression chamber, chamber-confined rotary means for displacing and compressing gas in said chamber, and spaced-apart gas inlet and outlet ports in communication with said chamber; unloading means for the compressor, comprising:

unloading port means, spaced apart from said inlet and outlet ports, opening both into said chamber and externally of said compressor; and valving means coupled to said unloading port means operative for opening and closing said unloading port means to a conduct of gas therethrough; wherein said compression chamber is defined by arcuate side walls and end walls joined to said side walls;

said unloading port means is formed in at least one of said end walls;

said outlet port is formed in at least one of said end walls;

said rotary means comprises a plurality of cooperating and co-acting rotors;

one of said rotors having a surface which cyclically exposes and occludes said outlet port;

another of said rotors has a surface which cyclically exposes and occludes said unloading port means;

said compression chamber is defined by a plurality of axially-extending, parallel and intersecting bores;

said one rotor rotates in a first of said bores about the axis thereof;

said another rotor rotates in a second of said bores about the axis thereof;

said outlet port opens onto said first bore;

said outlet port extends along an angular arc; drawn from said axis of said first bore, defining of said outlet port, relative to a rotary direction of said one rotor, leading and trailing portions, said trailing portion having a trailing edge; and said outlet port being located, relative to said unloading port means, such that a radial line drawn from said axis of said first bore and through the radially outermost portion of said trailing edge will substantially bisect said unloading port means.

2. In a compressor, according to claim 1, wherein:

said rotors have configurations cooperative with each other and said walls to subdivide said compression chamber into a plurality of sub-chambers; and said surfaces, configurations, and walls cooperate to expose one of said unloading port means and outlet port to one of said sub-chambers while occluding others of said unloading port means and outlet port from said one sub-chamber.

3. In a compressor, according to claim 2, wherein:

said rotors cooperate to form at least two of said sub-chambers, and cause one of said sub-chambers to diminish in volume while the other thereof increases in volume.

4. In a compressor, according to claim 3, wherein:

said rotors cooperate to expose only said diminishing-volume sub-chamber to said outlet port while exposing only said increasing-volume sub-chamber to said inlet port.

5. In a compressor, according to claim 2, wherein:

said rotors cooperate to form at least three of said sub-chambers, and cause one of said sub-chambers to increase in volume, while a third thereof maintains a given volume.

6. In a compressor, according to claim 5, wherein:

said rotors cooperate to expose only said diminishing sub-chamber to said unloading port means while said outlet port is occluded, and cooperate to expose only said third sub-chamber to said unloading port means while said diminishing sub-chamber is exposed to said outlet port.

7. In a compressor, according to claim 1, wherein:

said one rotor has a sector which defines said surface which exposes and occludes said outlet port; and said another rotor has a sector which defines said surface which exposes and occludes said unloading port means.

8. In a compressor, according to claim 7, wherein:

said unloading port means opens onto said second bore.

9. In a compressor, according to claim 7, wherein:

said sectors have leading and trailing portions, defined by rotary directions of said rotors; and said leading portion of said sector of said another rotor completes occlusion of said unloading port means, as said trailing portion of said sector of said one rotor terminates occlusion of said outlet port.

10. In a compressor, according to claim 9, wherein:

said trailing portions of said sectors, during each rotary cycle, expose said outlet port and said unloading port means to said compression chamber, simultaneously, for approximately one-quarter of said each cycle.

11. In a compressor, according to claim 1, wherein:

said valving means comprises a metering valve;

said valve having a movable valving element, and an apertured valve seat therefor;

said valving element being movable between fully open and fully closed positions in infinite steps.

12. In a compressor, according to claim 11, wherein:

said valving means further comprises a valve housing;

said valving element being movably supported in said valve housing; and further including piston means coupled to said valving element; wherein said valve housing has port means formed therein for admitting differential gas pressures thereinto to effect movement of said piston means and said valving element;

said valving housing further having a venting aperture formed therein for communication thereof with said apertured valve seat upon said piston means and valving element being moved in a given direction.

* * * * *